US009903074B2

(12) United States Patent
Cox

(10) Patent No.: US 9,903,074 B2
(45) Date of Patent: Feb. 27, 2018

(54) RAILWAY RAIL ANCHORING DEVICE

(71) Applicant: PANDROL LIMITED, Addlestone, Surrey (GB)

(72) Inventor: Stephen John Cox, Richmond (GB)

(73) Assignee: Pandrol Limited, Addlestone, Surrey (GB)

( * ) Notice: Subject to any disclaimer, the term of this patent is extended or adjusted under 35 U.S.C. 154(b) by 156 days.

(21) Appl. No.: 14/765,464

(22) PCT Filed: Jan. 24, 2014

(86) PCT No.: PCT/GB2014/050182
§ 371 (c)(1),
(2) Date: Aug. 3, 2015

(87) PCT Pub. No.: WO2014/118512
PCT Pub. Date: Aug. 7, 2014

(65) Prior Publication Data

US 2015/0376843 A1 Dec. 31, 2015

(30) Foreign Application Priority Data

Feb. 4, 2013 (GB) ..... 1301956.7

(51) Int. Cl.
*E01B 9/66* (2006.01)
*E01B 9/28* (2006.01)
*E01B 9/38* (2006.01)

(52) U.S. Cl.
CPC ..... *E01B 9/66* (2013.01); *E01B 9/28* (2013.01); *E01B 9/38* (2013.01)

(58) Field of Classification Search
CPC ..... E01B 9/66; E01B 9/28; E01B 9/36; E01B 9/38; E01B 9/62; E01B 9/30; E01B 9/40; E01B 9/16; E01B 9/18; E01B 9/14
See application file for complete search history.

(56) References Cited

U.S. PATENT DOCUMENTS 4,382,547 A * 5/1983 Phillips ..... E01B 9/10 238/281
4,802,623 A * 2/1989 Fasterding ..... E01B 3/32 238/106
5,494,212 A * 2/1996 Owen ..... E01B 9/28 238/265

(Continued)

FOREIGN PATENT DOCUMENTS

AT 502 150 A1 1/2007
CN 102089478 A 6/2011

(Continued)

OTHER PUBLICATIONS

International Search Report dated Jul. 17, 2014 in connection with International Application No. PCT/GB2014/050182 (6 pages).

(Continued)

*Primary Examiner* — Jason C Smith
(74) *Attorney, Agent, or Firm* — Husch Blackwell LLP

(57) ABSTRACT

A railway rail anchoring device (12) for fastening a railway rail (16) to an underlying foundation (18), the anchoring device comprising a protrusion (28), the anchoring device protrusion being configured to cooperate with a corresponding recess (36) provided in a receiving portion associated with the underlying foundation.

20 Claims, 9 Drawing Sheets

(56) References Cited

U.S. PATENT DOCUMENTS

| | | | | |
|---|---|---|---|---|
| 5,758,821 | A * | 6/1998 | Wirthwein | E01B 9/14 238/366 |
| 6,761,322 | B1 * | 7/2004 | Porrill | E01B 9/483 238/264 |
| 2009/0045265 | A1 * | 2/2009 | Cox | E01B 3/28 238/343 |
| 2009/0308943 | A1 * | 12/2009 | Wirthwein | E01B 9/30 238/310 |
| 2010/0206958 | A1 * | 8/2010 | Cox | E01B 9/686 238/283 |
| 2012/0091216 | A1 * | 4/2012 | Osler | E01B 9/38 238/283 |
| 2012/0160924 | A1 * | 6/2012 | Cox | E01B 9/306 238/84 |
| 2012/0187207 | A1 * | 7/2012 | Cox | E01B 9/685 238/283 |
| 2012/0318881 | A1 * | 12/2012 | Cox | E01B 9/36 238/338 |
| 2016/0355991 | A1 * | 12/2016 | Keightley | E01B 9/66 |

FOREIGN PATENT DOCUMENTS

| | | | |
|---|---|---|---|
| DE | 954 257 | C | 12/1956 |
| GB | 345 865 | A | 4/1931 |
| GB | 1 336 999 | A | 11/1973 |
| GB | 2 351 515 | A1 | 1/2001 |
| JP | 2000 265403 | A | 9/2000 |

OTHER PUBLICATIONS

Written Opinion of the International Searching Authority dated Jul. 17, 2014 in connection with International Application No. PCT/GB2014/050182 (8 pages).

GB Search Report dated May 29, 2013 in connection with GB Application No. 1301956.7 (4 pages).

English translation of Abstract of JP 2000 265403.

English translation of DE 954 257.

English translation of AT 502 150 A1.

International Preliminary Report on Patentability and Written Opinion of the International Searching Authority for corresponding PCT application PCT/GB2014/050182, dated Aug. 13, 2015.

First Office Action for corresponding CN patent application 201480007452.0, dated May 4, 2016.

English-language translation of First Office Action for corresponding CN patent application 201480007452.0, dated May 4, 2016.

English-language translation of abstract for CN 102089478 A, published Jun. 8, 2011.

* cited by examiner

RAILWAY RAIL ANCHORING DEVICE

This application is a national phase application of International Patent Application Serial No. PCT/GB2014/050182 filed Jan. 24, 2014 and entitled "A RAILWAY RAIL ANCHORING DEVICE," which claims the benefit of the filing date of Great Britain Application Serial No. 1301956.7 filed Feb. 4, 2013 and entitled "A Railway Rail Anchoring Device." The disclosures of these applications are fully incorporated herein by reference.

The present invention relates to a railway rail anchoring device.

BACKGROUND

In railway track fastening applications, two important parameters associated with a track fastening are its ability to provide vertical adjustment and its vertical stiffness.

Vertical adjustment is required to make corrections to rail level, particularly in the case of slab track applications (i.e. those without ballast) where it is not possible to adjust (i.e. "tamp") the ballast.

For such applications which require moderate levels of stiffness, it is typical to provide a fastening system with an adjustable baseplate where the only resilience comes from a rail pad that fits between the rail and the baseplate. The baseplate provides the capability of adjustment, but adds significantly to the cost and weight of the rail fastening system.

Accordingly, a rail fastening assembly that can provide moderate stiffness and vertical adjustment without an expensive or heavy baseplate is desirable.

The present disclosure seeks to address this issue.

STATEMENTS OF INVENTION

According to a first aspect of the invention there is provided a railway rail anchoring device for fastening a railway rail to an underlying foundation, the anchoring device comprising a protrusion provided on a lower surface of the anchoring device, the anchoring device protrusion being configured to engage with a corresponding recess provided in a receiving portion associated with the underlying foundation, wherein the anchoring device protrusion is further configured such that the engagement of the anchoring device protrusion with the receiving portion recess permits a substantially vertical adjustment of the anchoring device relative to the underlying foundation and that the anchoring device protrusion and recess remain in engagement during such vertical adjustment.

The anchoring device may be configured to receive a first fastening means for fastening the anchoring device to the underlying foundation when in an installed configuration. The anchoring device may be further configured to receive a second fastening means, which bears down on the rail when in the installed configuration. The second fastening means may be separate from the first fastening means.

Accordingly, the rail may be clamped to the underlying foundation indirectly, e.g. via the first fastening means, anchoring device and second fastening means.

Accordingly, the present invention advantageously provides a means for fastening a railway that may have moderate stiffness and the ability to make positional adjustments.

The anchoring device protrusion may be configured such that the cooperation of the anchoring device protrusion with the receiving portion recess may limit lateral movement and/or rotation of the anchoring device relative to the underlying foundation.

The anchoring device protrusion may be provided on a lower surface of the anchoring device. The anchoring device protrusion may extend from the lower surface, e.g. in a downwards direction when in the installed configuration.

The anchoring device protrusion may be provided at a position further away from the railway rail than the first fastening means configured to fasten the anchoring device to the underlying foundation when in an installed configuration. Alternatively, the anchoring device protrusion may be provided at a position closer to the railway rail than the first fastening means configured to fasten the anchoring device to the underlying foundation when in an installed configuration.

The anchoring device protrusion may be provided in a region of the anchoring device away from the railway rail when in the installed configuration. Alternatively, the anchoring device protrusion may be provided in a region of the anchoring device adjacent to the railway rail when in the installed configuration.

The second fastening means may comprise a rail fastening clip. The anchoring device may be configured to receive the rail fastening clip, which may bear down on the rail when in the installed configuration. In the event that the anchoring device engages a clip, the anchoring device protrusion may be provided on the lower surface of the anchoring device at a point spaced apart from a contact point at which the clip contacts the anchoring device in an installed configuration. The railway rail anchoring device may comprise a railway rail fastening clip anchoring device.

The anchoring device may engage directly with the underlying foundation, for example, the anchoring device may be directly fastened to the underlying foundation. The anchoring device may further comprise an opening configured to cooperate with the first fastening means, e.g. a bolt. The first fastening means may be configured to fasten the anchoring device to the underlying foundation. The opening may be provided in a region of the anchoring device adjacent to the rail when in the installed configuration, e.g. so that the opening may be closer to the rail than the protrusion. Alternatively, the opening may be provided in a region of the anchoring device away from the rail when in the installed configuration.

The anchoring device protrusion may comprise a first side surface and a second side surface. The first side surface and/or the second side surface may be substantially perpendicular to a lower surface of the anchoring device. The first side surface and/or the second side surface may be angled relative to the lower surface of the anchoring device, e.g. such that the first side surface and/or the second side surface are vertical in the installed configuration.

A railway rail fastening assembly may comprise the railway rail anchoring device described above.

The railway rail fastening assembly may further comprise the receiving portion associated with the underlying foundation. The receiving portion may comprise the recess. The recess may be provided in the underlying foundation. The receiving portion may be a portion of the underlying foundation. The receiving portion may be separate from the underlying foundation. The receiving portion may be substantially level with the underlying foundation. For example, a top surface of the receiving portion may be substantially level with a top surface of the underlying foundation.

The receiving portion recess may comprise a first side surface and a second side surface. The first side surface and/or the second side surface may be substantially perpendicular to a lower surface of the anchoring device and/or the local top surface of the receiving portion when in the installed configuration. The first side surface and/or the second side surface may be angled relative to the lower surface of the anchoring device and/or the local top surface of the receiving portion, e.g. such that the first side surface and/or the second side surface are vertical in the installed configuration.

The railway rail fastening assembly may further comprise an intermediate member. The intermediate member may comprise the receiving portion such that the recess is provided in the intermediate member. The intermediate member may be configured for placement between the anchoring device and the underlying foundation. Alternatively, the underlying foundation may comprise the receiving portion with the recess.

The intermediate member may advantageously provide a mould surface to form the recess in the underlying foundation. The intermediate member may also advantageously provide a more resilient surface for the anchoring device protrusion to engage with.

The intermediate member may comprise a protrusion. The intermediate member protrusion may be configured to engage a further recess provided in the underlying foundation. Alternatively, the intermediate member may not comprise a protrusion and the intermediate member may fit in a further recess provided in the underlying foundation.

The recess may be provided on a first surface of the intermediate member. The intermediate member protrusion may be provided on a second surface of the intermediate member. The first surface may oppose the second surface. The recess and intermediate member protrusion may or may not be coincident. A structure forming the intermediate member protrusion may also form the recess.

The intermediate member may further comprise one or more fastening means receiving portions. The fastening means receiving portions may be configured to cooperate with the first fastening means. The first fastening means may be configured to fasten the anchoring device to the underlying foundation. The fastening means receiving portions may be integral with or separate from the remainder of the intermediate member.

The intermediate member and the underlying foundation may be joined together, e.g. by virtue of casting. The intermediate member may be configured such that it may be cast into the underlying foundation. For example, the intermediate member may comprise formations for interacting with the underlying foundation when cast.

The railway rail fastening assembly may further comprise one or more shims. The shims may be configured for placement between the anchoring device and the underlying foundation. The one or more shims may comprise a first side and a second side. The first and/or second sides may be substantially flat.

The railway rail fastening assembly may further comprise one or more fastening means, one or more rail clips, a further anchoring device for other side of rail and/or one or more base-plates.

According to a second aspect of the present invention there may provided a railway rail fastening assembly, the railway rail fastening assembly comprising: a railway rail anchoring device for fastening a railway rail to an underlying foundation; and an intermediate member, the intermediate member being configured for placement between the anchoring device and the underlying foundation, wherein the anchoring device is configured to receive a first fastening means for fastening the anchoring device to the underlying foundation when in an installed configuration, wherein the anchoring device is further configured to receive a second fastening means, which bears down on the rail when in the installed configuration, the second fastening means being separate from the first fastening means, wherein the anchoring device comprises a protrusion provided on a lower surface of the anchoring device, the anchoring device protrusion being configured to engage with a corresponding recess provided in the intermediate member, wherein the anchoring device protrusion is further configured such that the engagement of the anchoring device protrusion with the intermediate member recess permits a substantially vertical adjustment of the anchoring device relative to the underlying foundation and that the anchoring device protrusion and recess remain in engagement during such adjustment, and wherein the intermediate member is configured such that it may be cast into the underlying foundation.

According to a third aspect of the present invention there may provided an intermediate member configured for placement between the above-mentioned anchoring device and the underlying foundation, the intermediate member comprising one or more receiving portions with recesses, wherein the recesses are configured to engage with the anchoring device protrusions so as to permit a substantially vertical adjustment of the anchoring devices relative to the underlying foundation with the anchoring device protrusion and recess remaining in engagement during such adjustment.

The intermediate member may comprise two receiving portions each with a recess for engagement with a respective anchoring device. The two receiving portions may be arranged such that anchoring devices may be provided either side of the rail.

The intermediate member may further comprise one or more fastening means receiving portions. The fastening means receiving portions may be configured to cooperate with a first fastening means. The first fastening means may be configured to fasten the anchoring device to the underlying foundation. The intermediate member may be configured such that it may be cast into the underlying foundation.

According to a fourth aspect of the present invention there is provided a method of forming an underlying foundation, the method comprising: positioning the above-mentioned intermediate member; pouring a mixture, such as concrete or cement, around the intermediate member; and solidifying the mixture so as to form the underlying foundation with the intermediate member fixed to the underlying foundation. The method may comprise: placing the above-mentioned intermediate member in a mould; and forming the underlying foundation in the mould such that the underlying foundation is formed around the intermediate member.

The underlying foundation may comprise a sleeper or a slab, e.g. as used in track slab application. The underlying foundation may be formed from concrete, cement or any other mouldable material.

BRIEF DESCRIPTION OF THE DRAWINGS

Reference will now be made to the accompanying drawings in which.

DETAILED DESCRIPTION

Figure 1A:
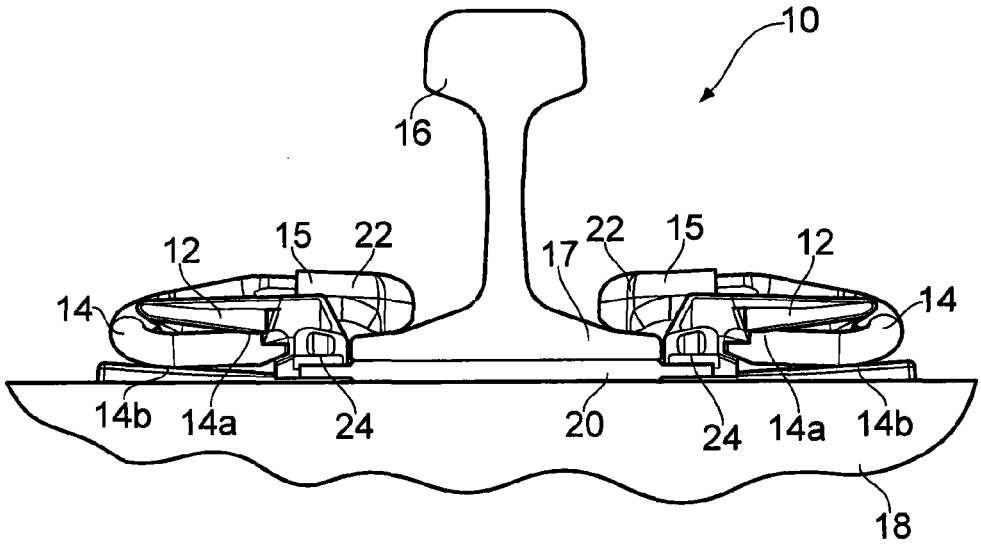
FIGS. 1*a* and 1*b* show side and plan views respectively of a railway rail fastening assembly according to an example of the present invention.
Figure 1B:
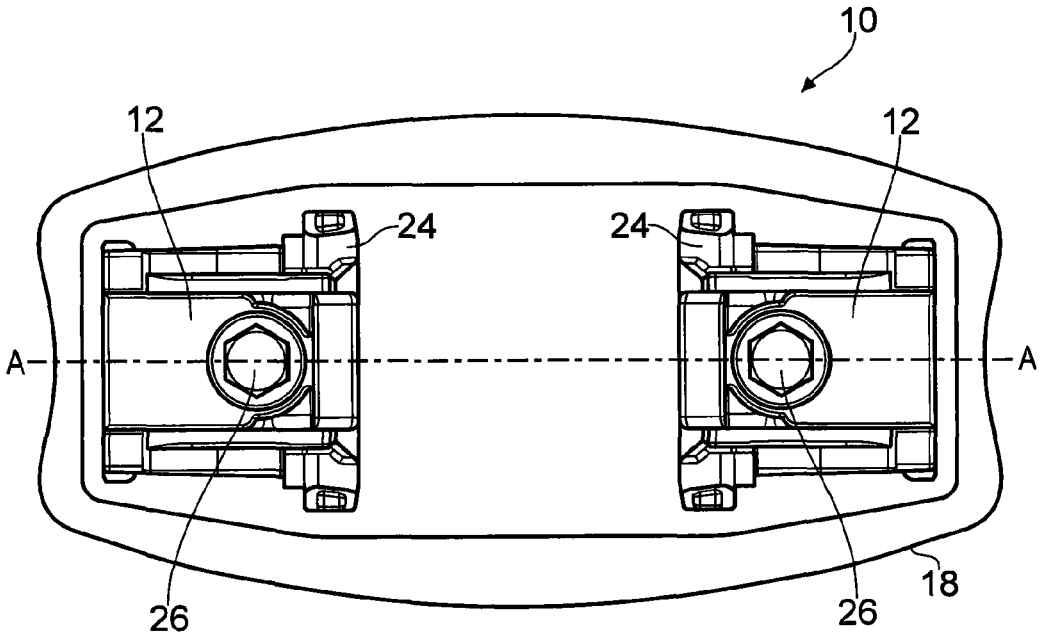

With reference to FIGS. 1*a* and 1*b* a railway rail fastening assembly 10, according to an example of the present invention, comprises an anchoring device 12, e.g. a shoulder, configured to receive a railway rail fastening clip 14. (The clip 14 has been omitted from FIG. 1*b*.) The anchoring device 12 is operatively connected to an underlying foundation 18 (Shown in part in FIGS. 1*a* and 1*b*), such as a railway sleeper or slab. Respective anchoring devices 12 are provided on either side of a railway rail 16 for retaining clips 14 which bear on a rail foot 17. The clip 14 secures the railway rail 16 to the underlying foundation by virtue of forces exerted by the clip on the anchoring device 12 and the rail 16.

The clip 14 may be configured such that it can be deflected from a non-operative configuration to at least one operative configuration in which a toe portion 15 of the clip bears on the rail. The clip 14 may be resilient and may be made from a rod of resilient material. The clip 14, as shown in FIG. 1*a*, may be of the type that is inserted into engagement with the anchoring device 12 and rail 16 in a substantially lateral direction relative to a longitudinal axis of the rail.

The railway rail fastening assembly 10 may further comprise a railway rail pad 20. The pad 20 may comprise a plate of resilient material for providing cushioning between the rail foot 17 and the underlying foundation 18.

The railway rail fastening assembly 10 may further comprise one or more electrically insulating wear pieces, such as a toe insulator 22 and a side post insulator 24. The toe insulator 22 may be carried by the toe portion 15 of the clip 14 and may bear against the rail foot 17 in an installed configuration. The toe insulator 22 may electrically insulate the rail from the clip and/or limit wear between the rail and the clip. The side post insulator 24 may be positioned between the anchoring device 12 and the rail foot 17 in an installed configuration and the side post insulator 24 may extend along the width of the anchoring device. The side post insulator 24 may electrically insulate the rail from the anchoring device and/or limit wear between the rail and the anchoring device.

With particular reference to FIG. 1*b*, the railway rail fastening assembly 10 may further comprise one or more fastening means 26, such as a bolt. The fastening means 26 may be configured to fasten the anchoring device 12 to the underlying foundation 18.

Referring now to FIGS. 2*a* to 2*e*, the anchoring device 12 comprises a protrusion 28 provided on a lower surface 30 of the anchoring device, e.g. facing the underlying foundation when in the installed configuration. The anchoring device protrusion 28 is configured to cooperate with a corresponding recess described with reference to FIG. 3 below. The recess is provided in a receiving portion associated with the underlying foundation. The cooperation of the anchoring device protrusion 28 with the receiving portion recess permits a substantially vertical adjustment of the anchoring device 12 relative to the underlying foundation 18.

It is appreciated that the rail may be angled with respect to the vertical, e.g. due to opposing rails being angled towards one another and/or due to a cant angle. As a result, references to a substantially vertical adjustment of the anchoring device may also comprise a component of lateral adjustment, e.g. the adjustment may be in a direction substantially parallel to a midline of the respective rail. Alternatively, the adjustment may be in a vertical direction whether the rail is angled or not. In any event, references to a vertical adjustment of the anchoring device may simply mean that the anchoring device has been adjusted to a higher or lower position.

Figure 2A:
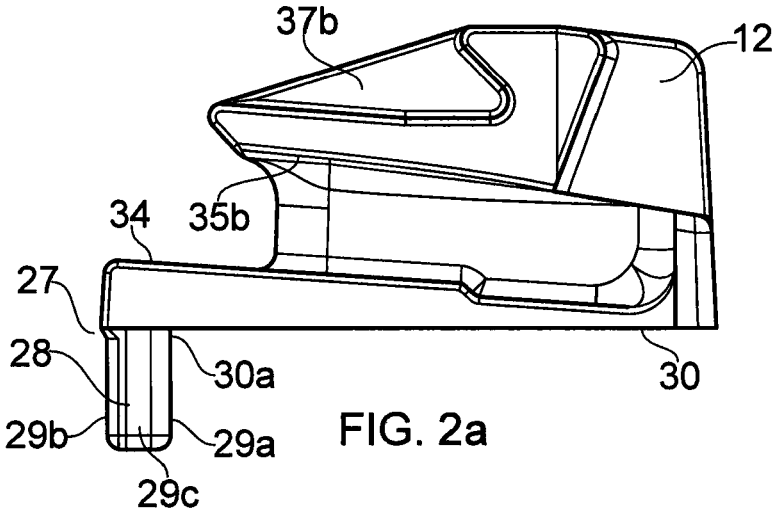
FIGS. 2*a*, 2*b* and 2*c* show a side view, a first perspective view and a second perspective view respectively of a railway rail fastening clip anchoring device according to an example of the present invention.
Figure 2B:
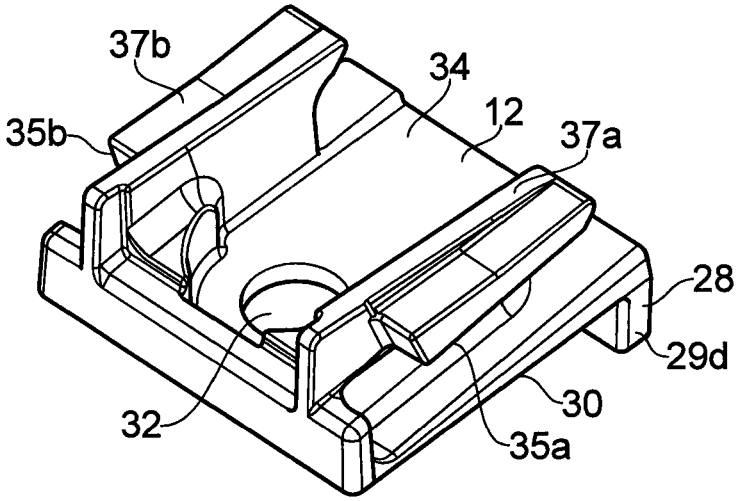

As best shown in FIG. 2*b*, the anchoring device further comprises an opening 32 configured to cooperate with the fastening means 26. The fastening means 26 passes through opening 32 when in the installed configuration. For example, a bolt shaft may pass through the opening 32. The opening 32 may be sized such that a head of the bolt, or intermediate washer, abuts a top surface 34 of the anchoring device. As mentioned above, the fastening means 26 is configured to fasten the anchoring device 12 to the underlying foundation 18.

As is also depicted in FIG. 2, the anchoring device comprises first and second engaging surfaces 35*a*, 35*b* for engaging respective portions of the clip 14. The first and second engaging surfaces 35*a*, 35*b* are provided on respective first and second side walls 37*a*, 37*b*, which extend from the top surface 34 of the anchoring device. The first and second engaging surfaces 35*a*, 35*b* are arranged so as to face the top surface 34. The first and second side walls 37*a*, 37*b* are provided either side of the opening 32.

The protrusion 28 may be provided in a region of the anchoring device 12 away from the railway rail 16 when in the installed configuration. In particular, the protrusion 28 may be provided at an end of the anchoring device 12 furthest from the railway rail 16. For example, the protrusion 28 may, at least in part, form a rear face 27 of the anchoring device. By contrast, the opening 32 may be provided in a region of the anchoring device adjacent to the rail 16 when in the installed configuration, e.g. as shown in FIG. 1*b*. The protrusion 28 may be spaced apart from the opening 32, e.g. an edge of the opening.

The protrusion 28 may be provided on the lower surface 30 of the anchoring device 12 at a point spaced apart from a contact point at which the clip 14 contacts the anchoring device in the installed configuration. With reference to FIG. 1*a*, the contact point may be a point 14*a* at which the clip 14 may exert a substantially upwards force on the anchoring device, e.g. via the first and second engaging surfaces 35*a*, 35*b*, or a point 14*b* at which the clip 14 may exert a substantially downwards force on the anchoring device, e.g.

via the top surface 34 of the anchoring device. In particular, the protrusion 28 may be set back (relative to the rail) from the point 14*b* at which the clip 14 may exert a substantially downwards force on the anchoring device.

Figure 2C:
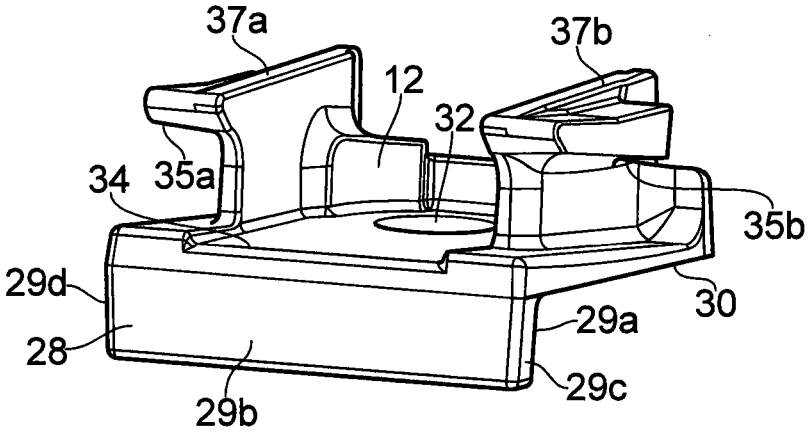

As shown in FIGS. 2*b* and 2*c*, the protrusion 28 may extend across the width, e.g. the entire width, of the anchoring device 12. The protrusion 28 may be substantially elongate and the protrusion 28 may extend in a direction substantially parallel to the longitudinal axis of the rail 16. The protrusion 28 cross-section (in a horizontal plane when installed) may however be any other shape, such as square, rectangular, or any other shape. The protrusion 28 may be integral with the anchoring device. Apart from the protrusion 28, the lower surface 30 of the anchoring device 12 may be substantially flat.

It will be appreciated that when in the installed configuration the clip 14 may exert a substantially upwards force on the anchoring device, e.g. via the first and second engaging surfaces 35*a*, 35*b*. In addition, the clip 14 may exert a substantially downwards force on the anchoring device, e.g. via the top surface 34 of the anchoring device. The fastening means 26 may also exert a substantially downwards force on the anchoring device 12. As a result of these forces, the anchoring device may be subject to a torque. The arrangement of the protrusion mentioned above, e.g. with the perpendicular side surfaces, may assist in resisting such a torque. Furthermore, the arrangement of the protrusion mentioned above ensures that contact is maintained between the protrusion and the recess when a substantially vertical adjustment is made.

Although a particular anchoring device, which cooperates with a corresponding clip, is shown in FIG. 2, it is envisaged that the present invention may apply to any other type of anchoring device, clip and/or anchoring devices without clips.

Figure 3A:
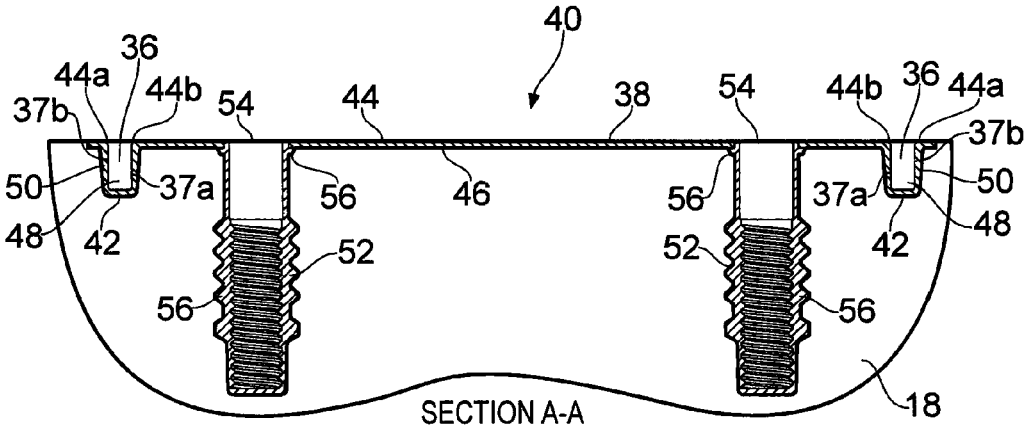
FIG. 3*a* shows a side sectional view of an intermediate member and FIGS. 3*b* and 3*c* show a plan view and a side sectional view respectively of an intermediate member according to an example of the present invention.
Figure 3B:
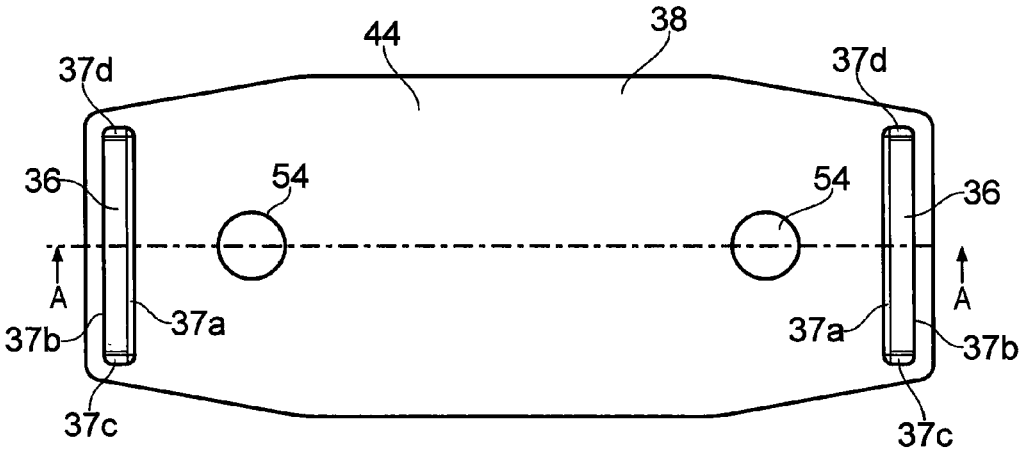
Figure 3C:
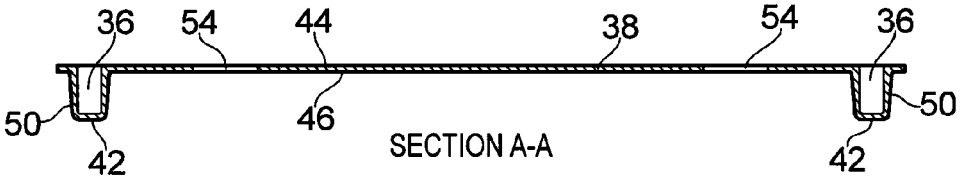

FIGS. 3*a*, 3*b* and 3*c* show an example of the above-mentioned recess 36, which is provided in a receiving portion associated with the underlying foundation 18. As depicted in FIG. 3, an intermediate member 38 may comprise the receiving portion with the recess 36.

Alternatively, the recess 36 may be provided in the underlying foundation itself, for example such that the receiving portion is part of the underlying foundation.

Accordingly, the railway rail fastening assembly 10 may further comprise an intermediate assembly 40 comprising the intermediate member 38. The intermediate member 38 comprises the receiving portion such that the recess 36 is provided in the intermediate member. The intermediate member 38 is configured for placement between the anchoring device 12 and the underlying foundation 18.

As depicted, the recess 36 is provided on a first surface 44 of the intermediate member 38, which is an upper facing surface when in the installed configuration. The first surface 44 of the intermediate member 38 may be substantially level with a top surface of the underlying foundation when in the installed configuration.

Referring to both FIGS. 2 and 3, further details of the protrusion and corresponding recess will now be described. The protrusion 28 comprises a first side surface 29*a* and a second side surface 29*b*. The first side surface 29*a* may face the rail 16 when in the installed configuration. The second side surface 29*b* may face away from the rail when in the installed configuration. The second side surface 29*b* may form, at least in part, the rear face 27 of the anchoring device. The first and/or second side surfaces 29*a*, 29*b* may reside in a plane that is substantially parallel to the longitudinal axis of the rail 16 when in the installed configuration. The first and second side surfaces 29*a*, 29*b* may be substantially parallel to one another. The first and/or second side surfaces 29*a*, 29*b* may be at least partially substantially flat. The first side surface and/or the second side surface 29*a*, 29*b* may be substantially perpendicular to the lower surface 30 of the anchoring device. Accordingly, one of the first and second side surfaces 29*a*, 29*b* may be perpendicular to the lower surface 30, whilst the other side surface may not be perpendicular to the lower surface 30.

The receiving portion recess may comprise corresponding first and second side surfaces 37*a*, 37*b*. The first and second side surfaces 37*a*, 37*b* may be orientated in the same manner as the first and second side surfaces 29*a*, 29*b* of the protrusion. For example, the first recess side surface 37*a* and/or the second recess side surface 37*b* may be substantially perpendicular to the first surface 44 of the receiving portion and/or a lower surface of the anchoring device when in the installed configuration. The first and second recess side surfaces 37*a*, 37*b* may be substantially parallel to one another. However, one of the first and second recess side surfaces may be perpendicular to the lower surface 30, whilst the other recess side surface may not be perpendicular to the lower surface 30.

An interaction between respective recess side surfaces 37*a*, 37*b* and protrusion side surfaces 29*a*, 29*b* may restrict lateral movement of the anchoring device. The spacing between the first and second recess side surfaces 37*a*, 37*b* and spacing between the first and second protrusion side surfaces 29*a*, 29*b* may be configured such that there is a tight fit between the protrusion and recess in the lateral direction. However, the spacing between the first and second recess side surfaces may be greater than the spacing between the first and second protrusion side surfaces, e.g. so that there is a loose fit in the lateral direction.

The first protrusion side surface 29*a* and anchoring device lower surface 30 may meet at right angles, e.g. so as to define a substantially right-angled corner 30*a*. Alternatively, the corner between the first protrusion side surface 29*a* and the anchoring device lower surface 30 may be radiused. Similarly, one or more of the recess side surfaces 37*a*, 37*b* may meet the receiving portion upper surface at a right angle, e.g. so as to define a substantially right-angled corner 44*a*. Alternatively or additionally, the corner 44*b* between one or more of the recess side surfaces and the receiving portion upper surface 44 may be radiused.

The protrusion 28 may further comprise a first end surface 29*c* and a second end surface 29*d*. The first and second end surfaces 29*c*, 29*d* may be provided between the first and second side surfaces 29*a*, 29*b*. Accordingly, the receiving portion recess may comprise corresponding first and second end surfaces 37*c*, 37*d*. The first and second recess end surfaces 37*c*, 37*d* may be orientated in the same manner as the first and second end surfaces of the protrusion.

An interaction between respective recess end surfaces 37*c*, 37*d* and protrusion end surfaces 29*c*, 29*d* may restrict longitudinal movement of the anchoring device, e.g. in a direction parallel to the longitudinal axis of the rail. The spacing between the first and second recess end surfaces 37*c*, 37*d* and spacing between the first and second protrusion end surfaces 29*c*, 29*d* may be configured such that there is a tight fit between the protrusion and recess in the longitudinal direction. However, the spacing between the first and second recess end surfaces may be greater than the spacing between the first and second protrusion end surfaces, e.g. so that there is a loose fit in the longitudinal direction.

Referring again to FIG. 3, the intermediate member 38 may comprise a further protrusion 42, which is provided on a second surface 46 of the intermediate member. The second surface 46 opposes the first surface 44 and faces the underlying foundation when in the installed configuration. The intermediate member protrusion 42 is configured to engage a further recess 48 provided in the underlying foundation 18.

As depicted, the intermediate member recess 36 and intermediate member protrusion 42 may be coincident such that a structure 50 forming the intermediate member protrusion 42 also forms the intermediate member recess 36.

In an alternative configuration (not shown), the intermediate member may not comprise a protrusion and the entire second surface 46 of the intermediate member may fit in a recess provided in the underlying foundation. For example, the entire second surface 46 of the intermediate member may be substantially flat and the intermediate member may be a plate with recesses formed on a top surface. It will be appreciated that with such an arrangement, the thickness of the intermediate member 38 may be greater then the depth of the recess 36 on the first surface 44 of the intermediate member.

Whether an intermediate member is provided or not, the shape and dimensions of the recess 36, 48 may correspond to those of the anchoring device protrusion 28 such that the protrusion 28 fits within the recess 36, 48. For example, the recess 36, 38 may be substantially elongate and the recess 36, 38 may extend in a direction substantially parallel to the longitudinal axis of the rail 16.

It will be appreciated that the cooperation of the anchoring device protrusion with the receiving portion recess permits a substantially vertical adjustment of the anchoring device, and thus the rail, relative to the underlying foundation. It will also be appreciated that at least a portion of a lateral load between the anchoring device and the underlying foundation may be transmitted between the protrusion and the receiving portion recess.

The depth of the recess 36 may be greater than or equal to the height of the protrusion 28. The height of the protrusion 28 may be greater than the maximum anticipated vertical adjustment, e.g. so that there is an overlap between the protrusion 28 and the recess 36 when the maximum vertical adjustment has been made. In particular, the height of the protrusion 28 may be selected such that when the maximum vertical adjustment has been made there is an overlap between the protrusion and the recess sufficient to resist any lateral forces between the anchoring device and the underlying foundation. In other words, the height of the protrusion 28 may be greater than or equal to the sum of the maximum anticipated vertical adjustment and the minimum vertical overlap required between the protrusion and the recess.

By way of example, the height of the protrusion 28 (e.g. from the lower surface) may be approximately 20 mm. The depth of the recess 36 may also be approximately 20 mm, although it may be greater. The maximum anticipated vertical adjustment may be approximately 10 mm. The minimum vertical overlap between the protrusion and the recess may be approximately 10 mm. The first and second protrusion side surfaces 29*a*, 29*b* may be spaced apart by approximately 10 mm.

Figure 2D:
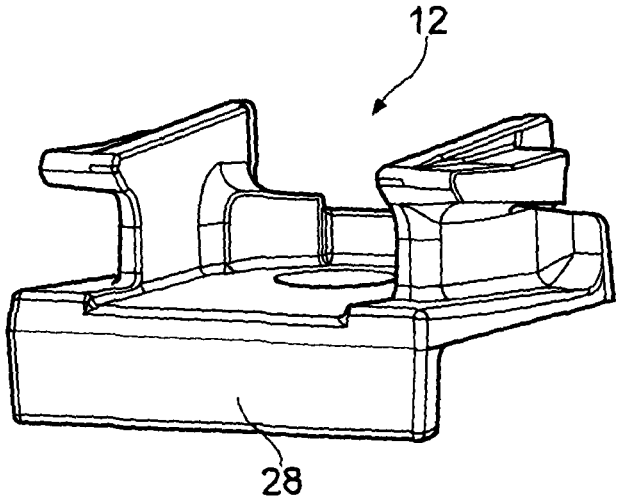
FIGS. 2*d* and 2*e* show perspective views of railway rail fastening clip anchoring devices with differing protrusion heights according to an example of the present invention.
Figure 2E:
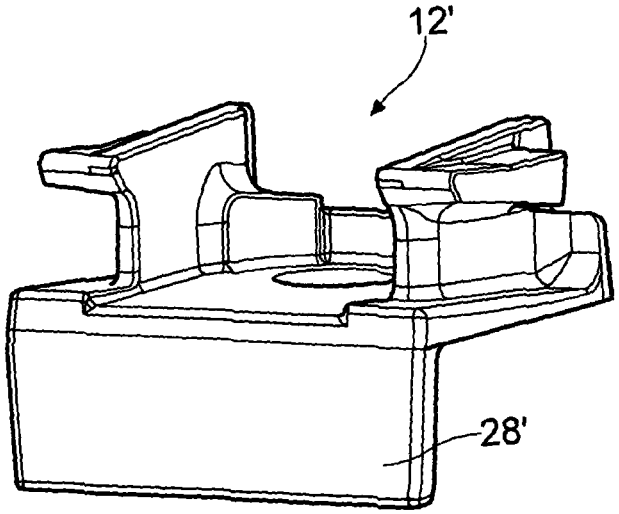

With particular reference to FIGS. 2*d* and 2*e*, anchoring devices 12, 12' with different protrusion heights may be provided. For example, a further anchoring device 12' may have a protrusion 28' with a height greater than the protrusion 28 of the anchoring device 12. The anchoring devices 12, 12' may otherwise have the same dimensions such that they may be interchangeable. The further anchoring device 12' may be used when a larger vertical adjustment may be required. The height of the protrusion 28' (e.g. from the lower surface) may be approximately 30 mm or may be any other desired value. Further anchoring devices with different protrusion heights may be provided, for example, a range of anchoring devices with varying protrusion heights.

The cooperation of the anchoring device protrusion 28 with the receiving portion recess 36, 48 may also limit movement of the anchoring device relative to the underlying foundation, e.g. in a horizontal plane. For example, the cooperation of the protrusion 28 with the recess 36 may limit movement of the anchoring device in a direction perpendicular to the longitudinal axis of the rail and/or in a direction parallel to the longitudinal axis of the rail. The cooperation of the protrusion 28 with the recess 36 may limit rotation of the anchoring device relative to the underlying foundation 18.

As shown in FIG. 3*a*, the intermediate assembly 40 may further comprise one or more fastening means receiving portions 52. The fastening means receiving portions 52 may cooperate with the fastening means 26 to secure the anchoring device 12 to the underlying foundation 18. The fastening means receiving portions 52 may be positioned between the fastening means 26 and the underlying foundation 18 when in an installed configuration. The fastening means receiving portions 52 may provide a surface for the fastening means 26 to engage, e.g. for the threads of a bolt to thread into. For example, an inner surface of the fastening means receiving portions 52 may be threaded.

The fastening means receiving portions 52 may be substantially tubular, e.g. so as to receive the fastening means 26, which may be in the form of a bolt. The fastening means receiving portions 52 extend from the second surface 46 of the intermediate member 38 and as such extend into the underlying foundation 18 when in the installed configuration.

The intermediate member 38 may comprise one or more openings 54. Each opening 54 may be associated with a corresponding fastening means receiving portion 52, such that the fastening means 26 may pass through the opening 54 in the intermediate member 38 and into the fastening means receiving portions 52. Accordingly, the fastening means receiving portions 52 may be open at an end which engages the intermediate member 38. By contrast, the opposite end of the fastening means receiving portions 52 may be closed.

The fastening means receiving portions 52 may or may not be integral with the intermediate member 38. In other words, the fastening means receiving portions 52 may be separate components from the intermediate member 38. The fastening means receiving portions 52 may engage with the respective openings 54 in the intermediate member 38. For example, the fastening means receiving portions 52 may be secured to the intermediate member 38 by virtue of an interference fit. Accordingly, the fastening means receiving portions 52 may be sized and/or shaped to fit in the intermediate member openings 54.

The fastening means receiving portions 52 may comprise an abutment shoulder 56 disposed about an outer surface of the fastening means receiving portions. The abutment shoulder 56 may comprise an annular ring. The abutment shoulder 56 may abut the second surface 46 of the intermediate member 38, e.g. to ensure that the fastening means receiving portions 52 do not protrude beyond the first surface 44 of the intermediate member. Accordingly, the abutment shoulder 56 may be set back from an end of the fastening means receiving portions 52, e.g. by a distance substantially equal to or less than the thickness of the intermediate member 38.

The fastening means receiving portions 52 may further comprise one or more splines (not shown) to resist rotational forces acting on the fastening means receiving portions. The splines may engage the underlying foundation or corresponding splines provided in the openings 54 of the intermediate member 38. The fastening means receiving portions 52 may further comprise one or more engaging surfaces 56 to engage the underlying foundation 18. The engaging surfaces 56 may resist movement of the fastening means receiving portions 52 (and hence fastening means 26) relative to the underlying foundation, e.g. in a vertical direction when in the installed configuration.

The recess 36 and opening 54 of the intermediate member 38 may be spaced apart by a distance corresponding to the spacing between the protrusion 28 and opening 32 of the anchoring device 12. In other words, when the protrusion 28 of the anchoring device 12 is located in the recess 36, the openings 32, 54 may coincide such that the fastening means 26 may pass through the openings to secure the anchoring device to the underlying foundation 18.

As is apparent from the Figures, the intermediate member 38 may comprise two openings 54 and two recesses 36, with each opening 54 and recess 36 corresponding to one anchoring device 12. Similarly, the intermediate member 38 may comprise two fastening means receiving portions 52 and hence two fastening means 26, e.g. one per each anchoring device.

Each intermediate member recess 36 may be provided at opposing ends of the intermediate member and each opening 54 may be set back from the respective ends of the intermediate member. The intermediate member 38 may be symmetrical about an axis substantially parallel to the longitudinal axis of the rail. The intermediate member 38 may also be symmetrical about an axis substantially perpendicular to the longitudinal axis of the rail.

It will be appreciated that the intermediate member 28 may support two anchoring devices 12, one at each end of the intermediate member. As depicted in FIG. 1*a*, the rail is supported between the two anchoring devices 12. The railway pad 20 may be placed between the intermediate member 38 and the rail foot 17.

The intermediate member 38 and/or fastening means receiving portions 52 may be formed of a plastic, such as a high viscosity nylon or any other suitable plastic. The cost and weight of these components may therefore be kept to a minimum. By contrast, the anchoring device 12 may be made from iron and may be cast iron.

The underlying foundation 18 may be formed by positioning the intermediate member 38; pouring a mixture around the intermediate member; and solidifying the mixture so as to form the underlying foundation with the intermediate member fixed to the underlying foundation. For example, the underlying foundation 18 may be formed by placing the intermediate assembly 40 in a mould (not shown) and filling the mould with an appropriate substance, such as concrete or cement. The intermediate assembly 40 may be held in place with respect to the mould by virtue of the fastening means receiving portions 52. For example, bolts may be inserted into the fastening means receiving portions 52 to hold the intermediate assembly in place relative to the mould. In this way, the intermediate assembly may be cast into the underlying foundation, e.g. such that the intermediate assembly and underlying foundation are joined together. The bolts and mould may then be removed and the underlying foundation can be put in place in the required location.

Alternatively, the underlying foundation 18 may be formed with a "top down" construction in which the intermediate assembly may be suspended in the required position, e.g. connected to the anchoring device and rail, and a mixture may be poured up underneath it to form the underlying foundation and fix the intermediate member in position. In either case, the intermediate member 38 may advantageously provide a mould surface to form the recess 48 in the underlying foundation.

Casting a recess with parallel sidewalls is difficult to reliably achieve. The intermediate member with the recess that may be cast into the underlying foundation advantageously overcomes this issue. The recess may be provided in the intermediate member and the intermediate member does not have to be removed from the underlying foundation.

Figure 4A:
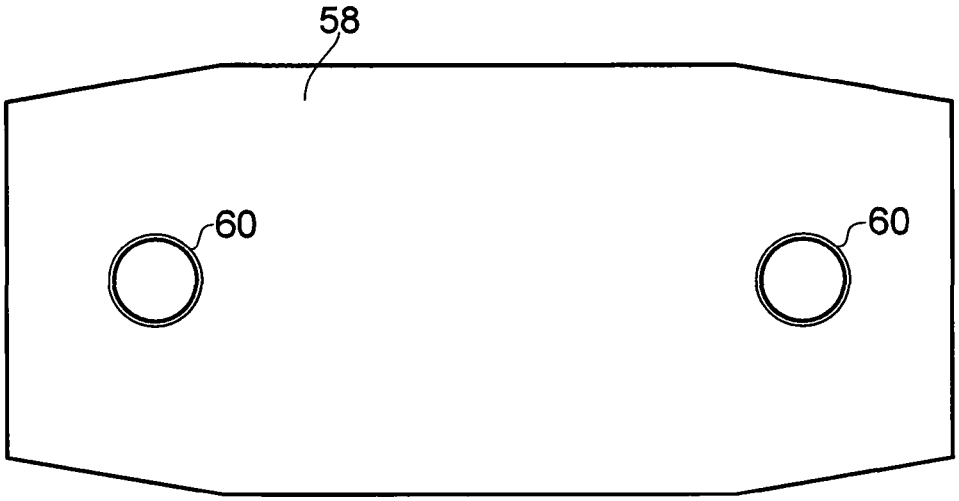
FIGS. 4*a* and 4*b* show a plan view and a side sectional view of a shim according to an example of the present invention.
Figure 4B:
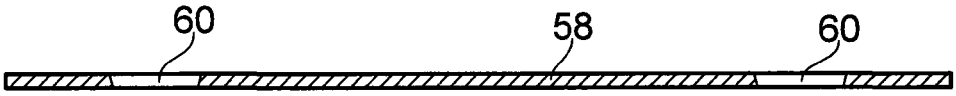

With reference to FIG. 4, the railway rail fastening assembly 10 may further comprise one or more shims 58 configured for placement between the anchoring device 12 and the underlying foundation 18 or intermediate member 38. The shim 58 may extend across both openings 54 of the intermediate member. As such, a pair of anchoring devices 28 either side of the rail may be placed on a single shim 58. The railway pad 20 may also be placed on the shim 58. The thickness of the shim 58 and/or number of shims may be varied to adjust the height of the anchoring devices 12 relative to the underlying foundation 18.

The shim 58 may be securely located in the installed configuration thanks to one or more openings 60 in the shim, through which the fastening means 26 may pass. The shim openings 60 may be spaced apart with the same spacing as the openings 54 in the intermediate member 38. The shim 58 may have substantially the same shape as the intermediate member 38. The shim 58 may be substantially flat on both sides.

The shims may be formed of a plastic, such as a high viscosity nylon or any other suitable plastic.

Figure 5:
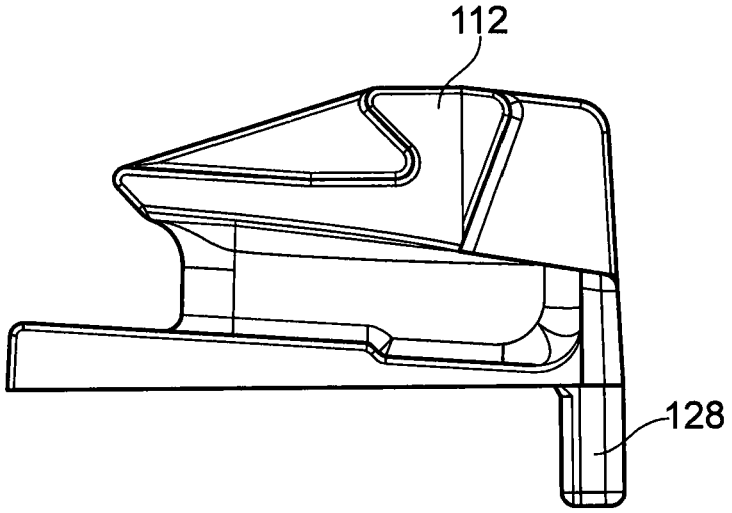
FIG. 5 shows a side view of a railway rail fastening clip anchoring device according to a further example of the present invention.

With reference to FIG. 5, in a further example of the present invention, the anchoring device protrusion 128 may be provided in a region of the anchoring device 112 adjacent to the railway rail when in an installed configuration. In particular, the protrusion 128 may be provided at an end of the anchoring device 112 closest to the railway rail 16. Accordingly, the position of the recess in the intermediate member may be adjusted such that each intermediate member opening may be provided at opposing ends of the intermediate member and each recess may be set back from the respective ends of the intermediate member. Otherwise, it will be appreciated that the features described above in respect of the intermediate assembly and anchoring device may apply equally to the intermediate member and anchoring device of this further example of the present invention.

Although not depicted, it will be appreciated that in the further example of the present invention, the opening for receiving the fastening means may be provided in a region of the anchoring device 112 away from the rail 16 when in the installed configuration.

Figure 6A:
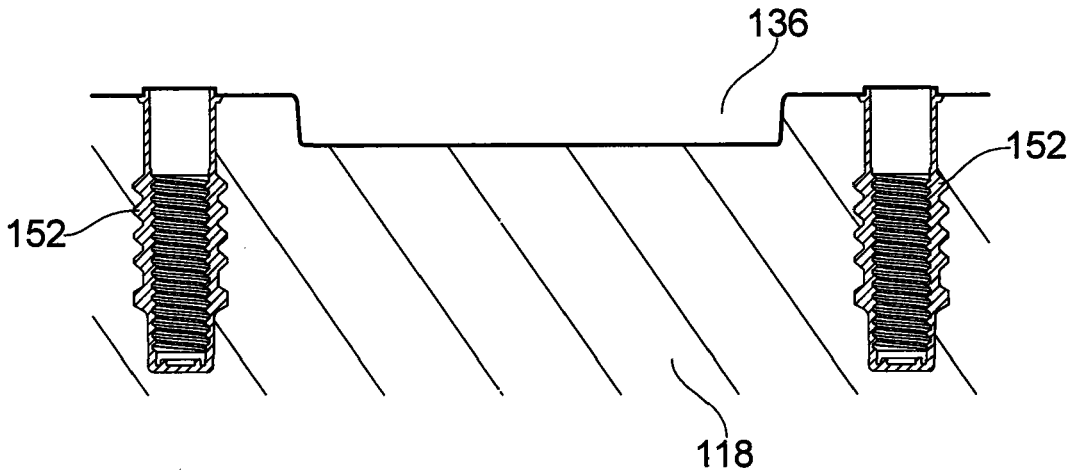
FIGS. 6*a* and 6*b* show sectional side views of railway underlying foundations according to further examples of the present invention.
Figure 6B:
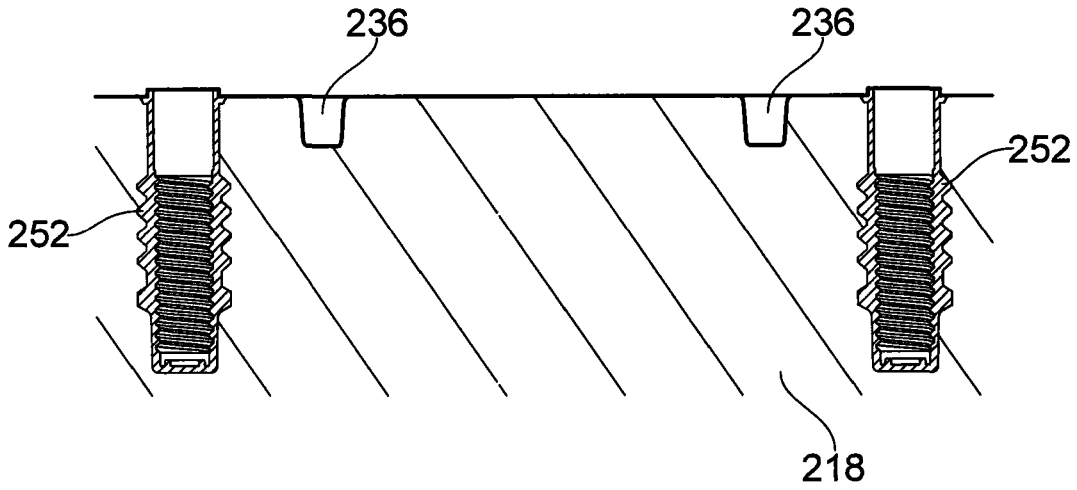

Referring now to FIGS. 6*a* and 6*b*, further examples of an underlying foundation 118, 218 are shown in part. As depicted in FIG. 6 and mentioned above, the intermediate member 38 may be omitted and the anchoring device protrusion 28, 128 may interface directly with a recess 136, 236 provided in the underlying foundation.

The particular examples shown in FIG. 6 are suited for the anchoring device 112 shown in FIG. 5, for which the protrusion 128 may be provided at an end of the anchoring device 112 closest to the railway rail 16. However, alternative underlying foundation arrangements are equally contemplated, which would cooperate directly with the anchoring device 12 shown in FIG. 2, for which the protrusion 28 may be provided at an end of the anchoring device 12 furthest from the railway rail 16.

As shown in FIG. 6*a*, the underlying foundation may comprise a single recess 136, or as depicted in FIG. 6*b*, two recesses 236 may be provided in the underlying foundation either side of the rail longitudinal axis. In the case of the single recess 136 shown in FIG. 6*a*, the railway pad 20 may reside in the recess 136. This arrangement may accommodate a larger rail pad, for example with a lower stiffness.

In either case, fastening means receiving portions 152, 252 may be provided to facilitate engagement of the fastening means 26 with the underlying foundation 118, 218. The fastening means receiving portions 152, 252 may be cast into the underlying foundations in a manner similar to that described above.

Figure 7A:
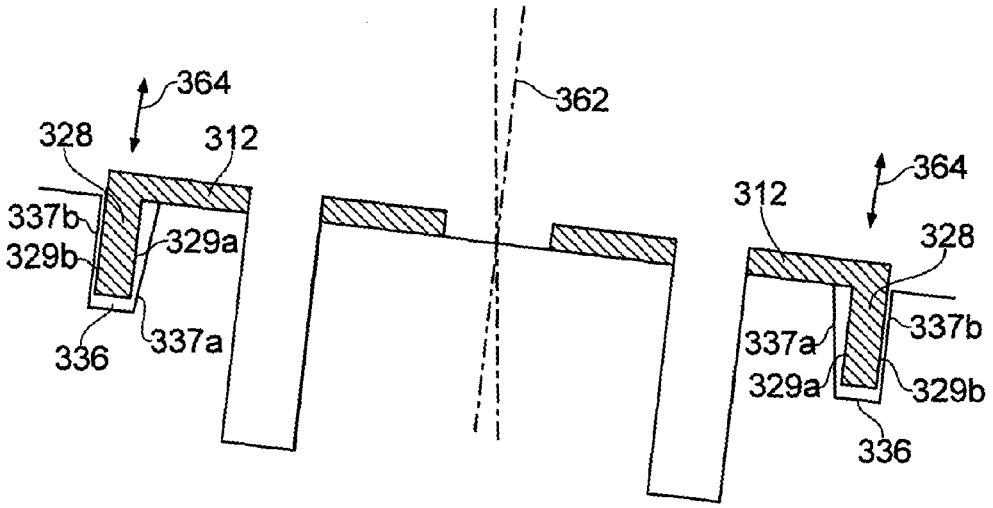
FIGS. 7*a* and 7*b* show schematic side views of alternative adjustment arrangements of the present invention.
Figure 7B:
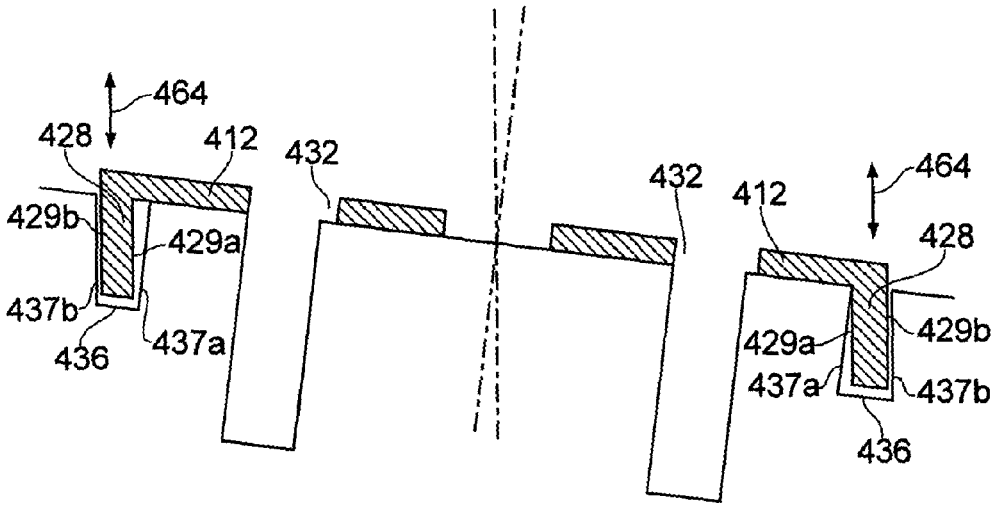

Referring now to FIGS. 7*a* and 7*b*, the rail may be angled with respect to the vertical, e.g. due to opposing rails being angled towards one another. As depicted in FIG. 7*a*, the recess 336 and protrusion 328 may be configured such that the adjustment may be in a direction substantially parallel to a midline 362 of the respective rail. In other words, the first and/or second protrusion side surfaces 329*a*, 329*b* may be parallel to the midline 362 of the rail. Similarly, the corresponding first and/or second recess side surfaces 337*a*, 337*b* may be parallel to the midline 362 of the rail. As a result, adjustment of the anchoring devices 312 may be in a direction 364 parallel to the midline 362 of the rail.

However, in an alternative arrangement depicted in FIG. 7*b*, the recess 436 and protrusion 428 may be configured such that the adjustment may be in a vertical direction despite the rail being angled. With the arrangement shown in FIG. 7*b*, the first and/or second protrusion side surfaces 429*a*, 429*b* may be vertical. Similarly, the corresponding first and/or second recess side surfaces 437*a*, 437*b* may be vertical. As a result, adjustment of the anchoring device 412 may be in a vertical direction 464.

With the arrangement shown in FIG. 7*b*, the opening 432 in the anchoring device 412 may be elongate, e.g. extending in a direction perpendicular to the longitudinal axis of the rail. The elongation of the opening 432 may permit lateral movement of the anchoring device 412 relative to the fastening means.

Figure 8:
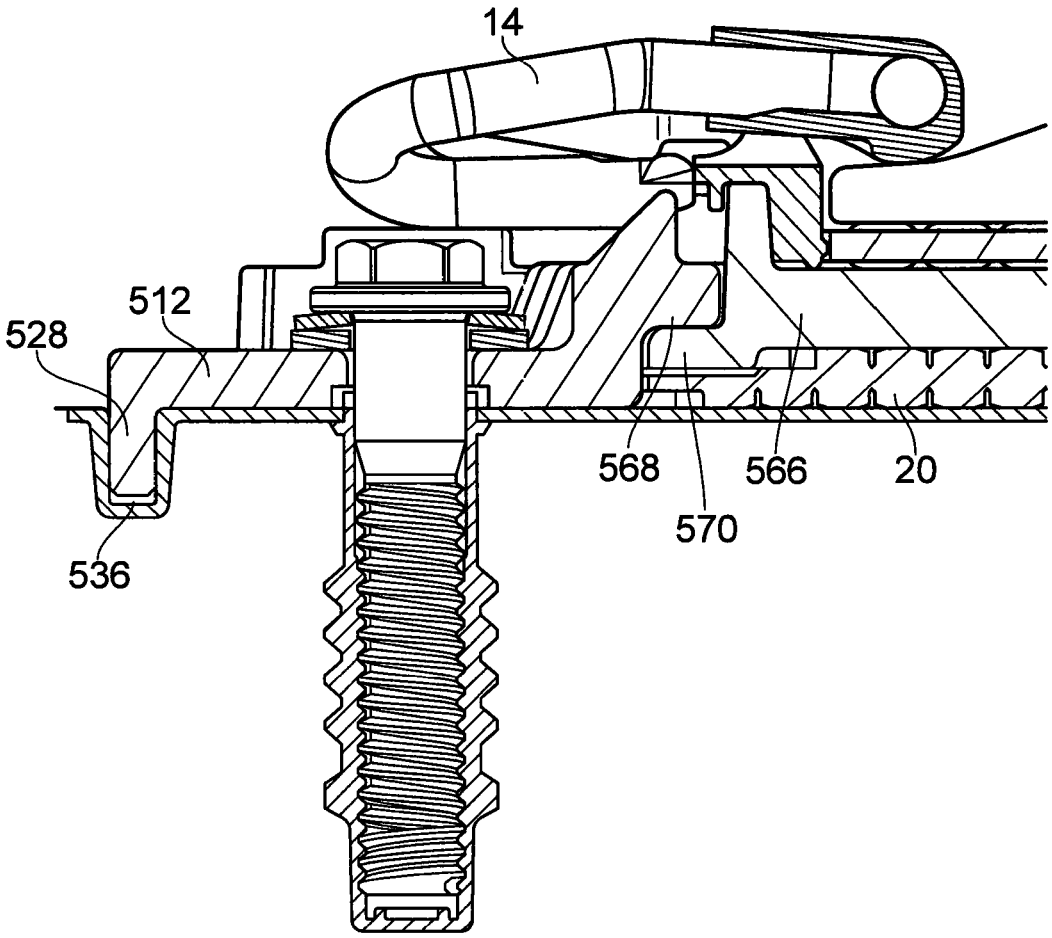
FIG. 8 shows a side view of a railway rail anchoring device according to a further example of the present invention.

The above-mentioned examples comprise an anchoring device which receives a fastening clip, which in turn bears down on the rail. However, as depicted in FIG. 8, in an alternative arrangement, the anchoring device 512 may not receive the clip 14. The anchoring device 512 may instead engage a base-plate 566, which may in turn receive the clip. The base-plate 566 may comprise one or more surfaces (not shown) which engage the clip. As for the previous examples, the anchoring device 512 comprise a protrusion 528 which engages a corresponding recess 536. In addition, the anchoring device 512 may comprise a lip 568 for engaging a corresponding portion 570 of the base-plate, the lip being configured to bear down on the base-plate and hold the base-plate in place. A corresponding anchoring device (not shown) may be provided on the other side of the base-plate, such that the base-plate is held down on both sides. The base-plate may be resiliently mounted with a pad 20 underneath.

The invention claimed is:

1. A railway rail anchoring device for fastening a railway rail to an underlying foundation, the railway rail anchoring device comprising:

a first protrusion provided on a lower surface of the railway rail anchoring device, the first protrusion being configured to engage with a corresponding recess provided in a receiving portion associated with the underlying foundation, the first protrusion being further configured such that engagement of the first protrusion with the corresponding recess permits a substantially vertical adjustment of the railway rail anchoring device relative to the underlying foundation and that the first protrusion and the corresponding recess remain in engagement during the substantially vertical adjustment, wherein the railway rail anchoring device is configured to receive a first fastening device for fastening the railway rail anchoring device to the underlying foundation when in an installed configuration, wherein the railway rail anchoring device is further configured to receive a second fastening device that bears down on the railway rail when in the installed configuration, the second fastening device being separate from the first fastening device, and wherein the first protrusion is substantially elongated and extends in a direction substantially parallel to a longitudinal axis of the railway rail.

2. The railway rail anchoring device as claimed in claim 1, wherein the first protrusion is configured such that cooperation of the first protrusion with the corresponding recess limits lateral movement of the railway rail anchoring device relative to the underlying foundation.

3. The railway rail anchoring device as claimed in claim 1, wherein the first protrusion is provided in one of a first region of the railway rail anchoring device away from the railway rail when in the installed configuration and a second region of the railway rail anchoring device adjacent to the railway rail when in the installed configuration.

4. The railway rail anchoring device as claimed in claim 1 further comprising an opening configured to cooperate with the first fastening device.

5. The railway rail anchoring device as claimed in claim 4, wherein the opening is provided in one of a first region of the railway rail anchoring device adjacent to the railway rail when in the installed configuration and a second region of the railway rail anchoring device away from the railway rail when in the installed configuration.

6. The railway rail anchoring device as claimed in claim 1, wherein the second fastening device comprises a rail fastening clip, the railway rail anchoring device being configured to receive the rail fastening clip, the rail fastening clip bearing down on the railway rail when in the installed configuration.

7. The railway rail anchoring device as claimed in claim 6, wherein the first protrusion is provided on the lower surface of the railway rail anchoring device at a point spaced apart from a contact point at which the rail fastening clip contacts the railway rail anchoring device in the installed configuration.

8. The railway rail anchoring device as claimed in claim 1, wherein the first protrusion comprises a first side surface and a second side surface, and wherein the first side surface or the second side surface is one of substantially perpendicular to the lower surface of the railway rail anchoring device and angled relative to the lower surface of the railway rail anchoring device such that the first side surface or the second side surface is vertical in the installed configuration.

9. A railway rail fastening assembly comprising the railway rail anchoring device of claim 1.

10. The railway rail fastening assembly as claimed in claim 9 further comprising an intermediate member, the intermediate member comprising the receiving portion such that the corresponding recess is provided in the intermediate member, the intermediate member being configured for placement between the railway rail anchoring device and the underlying foundation.

11. The railway rail fastening assembly as claimed in claim 10, wherein the intermediate member further comprises one or more fastening device receiving portions, the one or more fastening device receiving portions being configured to cooperate with the first fastening device.

12. The railway rail fastening assembly as claimed in claim 10, wherein the intermediate member comprises a second protrusion, the second protrusion being configured to engage a second recess provided in the underlying foundation.

13. The railway rail fastening assembly as claimed in claim 10, wherein the intermediate member is configured to be cast into the underlying foundation.

14. The railway rail fastening assembly as claimed in claim 9 further comprising the receiving portion associated with the underlying foundation, the receiving portion comprising the corresponding recess.

15. The railway rail fastening assembly as claimed in claim 14, wherein the corresponding recess comprises a first side surface and a second side surface, and wherein the first side surface or the second side surface is one of substantially perpendicular to the lower surface of the railway rail anchoring device when in the installed configuration and angled relative to the lower surface of the railway rail anchoring device such that the first side surface or the second side surface is vertical in the installed configuration.

16. An intermediate member configured for placement between the railway rail anchoring device of claim 1 and the underlying foundation, the intermediate member comprising the receiving portion with the corresponding recess, wherein the corresponding recess is configured to engage with the first protrusion extending in the direction substantially parallel to the longitudinal axis of the railway rail so as to permit the substantially vertical adjustment of the railway rail anchoring device relative to the underlying foundation with the first protrusion and the corresponding recess remaining in engagement during the substantially vertical adjustment.

17. The intermediate member as claimed in claim 16, wherein the receiving portion comprises a first receiving portion and a second receiving portion, wherein each of the first and second receiving portions includes a respective recess for engagement with the railway rail anchoring device, and wherein the first and second receiving portions are arranged such that railway rail anchoring device is provided on either side of the railway rail.

18. The intermediate member as claimed in claim 16, wherein the intermediate member further comprises one or more fastening device receiving sections, each of the one or more fastening device receiving sections being configured to cooperate with the first fastening device, the first fastening device being configured to fasten the railway rail anchoring device to the underlying foundation.

19. The intermediate member as claimed in claim 16, wherein the intermediate member is configured to be cast into the underlying foundation.

20. A method of forming the underlying foundation as in claim 16, the method comprising:

positioning the intermediate member;

pouring a mixture around the intermediate member; and solidifying the mixture so as to form the underlying foundation with the intermediate member fixed to the underlying foundation.

* * * * *